United States Patent [19]

Kuzuno et al.

[11] Patent Number: 4,952,155

[45] Date of Patent: Aug. 28, 1990

[54] ELECTRICAL CONNECTOR

[75] Inventors: Katsutoshi Kuzuno; Shigeo Ishizuka; Naoki Ito, all of Shizuoka, Japan

[73] Assignee: Yazaki Corporation, Japan

[21] Appl. No.: 343,668

[22] Filed: Apr. 27, 1989

[30] Foreign Application Priority Data

Apr. 28, 1988 [JP] Japan ..... 63-56763[U]

[51] Int. Cl.[5] ..... H01R 29/00

[52] U.S. Cl. ..... 439/49; 439/507

[58] Field of Search ..... 439/49, 189, 507–515, 439/518, 52

[56] References Cited

U.S. PATENT DOCUMENTS 3,917,371 11/1975 Hirokawa ..... 439/507

4,456,317 6/1984 McCleerey ..... 439/507

OTHER PUBLICATIONS

Japanese Laid Open Utility Model Publication No. 57–31791, 2–1982.

*Primary Examiner*—Neil Abrams

*Attorney, Agent, or Firm*—Wigman & Cohen

[57] ABSTRACT

Disclosed herein is an electrical connector, which comprises a male connector housing having a plurality of female terminals connected to wires, respectively, and a female connector housing, which is to be fitted to the male housing, having a plurality of male terminals connected to wires, respectively. Each of the female terminals has a first and a second tab receptacles, and each of the male terminal has a tab portion to be fitted to the first tab receptacle of the female terminals when the male and female housings are fitted together. The connector further comprises a joint terminal having at least one substantially U-shaped contact to be fitted to second tab receptacles of female terminals. The joint terminal is served to achieve electrical connection between some of the female terminals which are required to be electrically connected to each other.

5 Claims, 4 Drawing Sheets

ELECTRICAL CONNECTOR

BACKGROUND OF THE INVENTION

1. Field of the Invention

This invention relates to an electrical connector, and particularly to an electrical connector comprising a female housing and a male housing fitted to the female housing, in which not only wires connected to the female and male housings can be connected together but also wires connected to the female or the male housing can be connected together, respectively.

2. Description of the Prior Art

Conventionally, as a connector having a joint terminal similar to the present invention, there was known a connector disclosed in Japanese Laid Open Utility Model Publication No. 57-31791.

As shown in FIG. 1, the connector 11 comprises a connector housing 12 in which a plurality of female terminals 13 connected to wires 14 are accommodated, a joint terminal 15 having a plurality of tab portions 15*a* to be fitted to the female terminals 13, respectively, and a cover 16 for securing the joint terminal 15 to the female terminals 13. Namely, according to the prior art connector, it is possible to electrically connect some of the female terminals 13 which are necessary to be connected to each other by the joint terminal 15. One of the wires 14 connected to the terminals 13 joined by the joint terminal 15 could be served as a branch wire, so that according to the connector such a branch wire could be easily obtained.

However, the prior art connector 11 only serves to make electrical connection between the terminals 13 accommodated in the housing 12. This means that the connector 11 can not be used as a normal connector which is to be connected to another connector for achieving electrical connection therebetween. Further, in the prior art connector 11, since the wires 14 connected to the terminals 13 are extended toward the one direction, it is difficult to connect wires to the opposite direction due to the necessity of turning the wires to that direction. Therefore, use of the connector is relatively limited.

SUMMARY OF THE INVENTION

In view of the problem stated above, this invention has been made. Accordingly, an object of the present invention is to provide a connector having a female housing and a male housing fitted to the female housing, in which not only wires connected to the female and male housings can be connected together but also wires connected to the female or the male connector can be also connected together in accordance with the necessity of the electrical connection therebetween.

In order to achieve the above object, an electrical connector according to the present invention comprises a male connector housing having a plurality of female terminals connected to wires, respectively, and a female connector housing, which is to be fitted to the male housing, having a plurality of male terminals connected to wires, respectively. Each of the female terminals has a first and a second tab receptacles, and each of the male terminal has a tab portion to be fitted to the first tab receptacle of the female terminals when the male and female housings are fitted together. The connector further comprises a joint terminal to be fitted to the second tab receptacles of the female terminals for achieving electrical connection between some of the female terminals which are required to be electrically connected to each other.

According to the connector having the above structure, it is possible to achieve electrical connection between the wires connected to the male or female terminals by fitting the joint terminal to the female terminals which are fitted to the male terminals. The structure of the joint terminal can be arranged in accordance with the number or the positions of wires between which electrical connection is required. Further, in addition to the above effect, the connector can be used to achieve electrical connection between the wires of the male and female terminals of the female and male housings like a normal connector. Therefore, according to the connector of the present invention it is possible to make various wiring.

These and other objects and advantages of the present invention, as well as the details of the preferred embodiments, will be more fully understood when taken in conjunction with the following drawings.

DETAILED DESCRIPTION OF THE INVENTION

Figure 1:
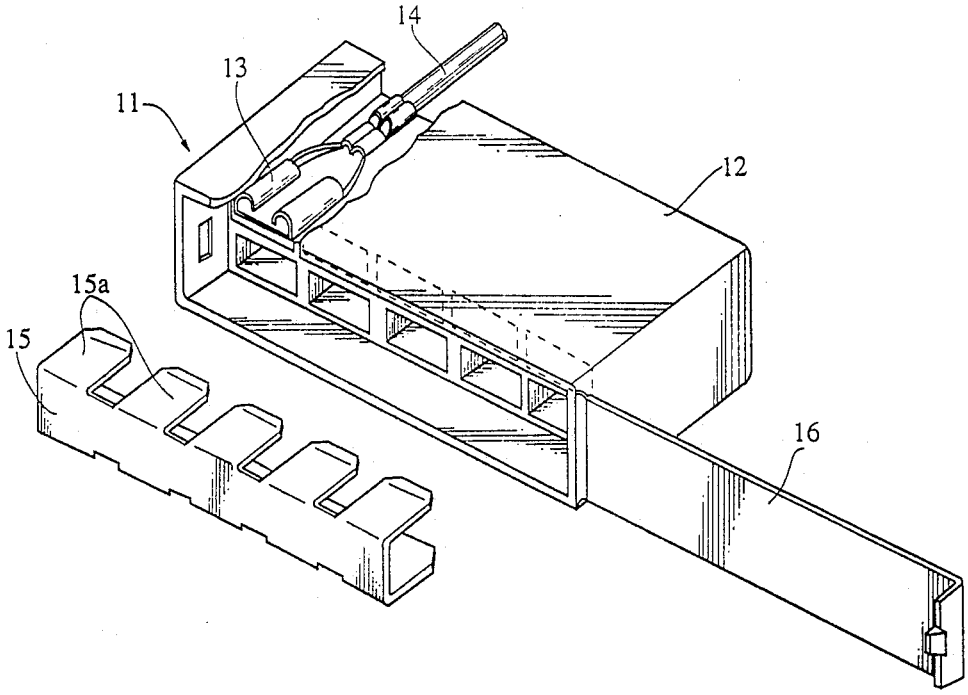
FIG.1 PRIOR ART
FIG. 1 is a perspective view of a prior art of the present invention.

Referring now to the drawings, a preferred embodiment of the present invention will be described.

Figure 2:
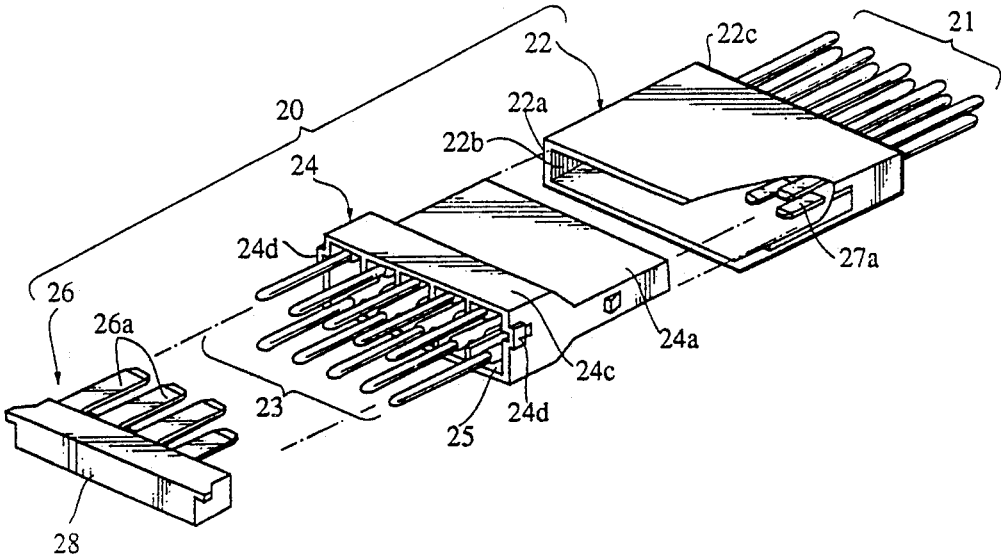
FIG. 2 is a perspective view of an embodiment of an electrical connector of the present invention.
Figure 3:
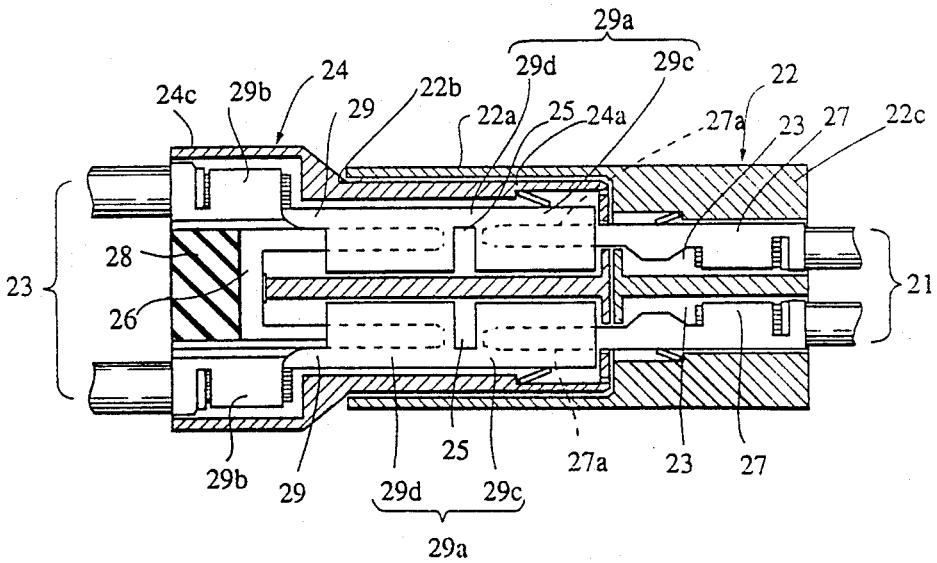
FIG. 3 is a cross sectional view of the connector of FIG. 2.

In FIGS. 2 and 3, an electrical connector 20 of the embodiment comprises a female housing 22, a male housing 24 to be fitted to the female housing 22 and a joint terminal 26 to be fitted to the male housing 24.

The female housing 22 includes a rectangular block of a plastics insulating materials having a front portion 22*a* with an opening 22*b* and a rear portion 22*b*. On the rear portion 22*c* of the female housing 22, there are formed ten terminal compartments 23 arranged in two rows each having five compartments 23. In each of the compartments 23, a male terminal 27 connected to an electrical wire 21 is accommodated in such a manner that a tab portion 27*a* of the male terminal 27 is extended toward the front portion 22*a* of the female housing 22.

The male housing 24 also includes a substantially rectangular block of a plastics insulating materials having a front portion 24*a* to be inserted into the opening 22*b* of the female housing 22 and a rear portion 24*c*. In the male housing 24, there are formed ten terminal compartments 25 arranged in two rows each having five compartments 25. In each of the compartments 25, a female terminal 29 connected to an electrical wire 23 is accommodated in such a manner that a tip portion of the terminal 29 is extended to the front portion 24*a* of the housing 24.

Figure 4:
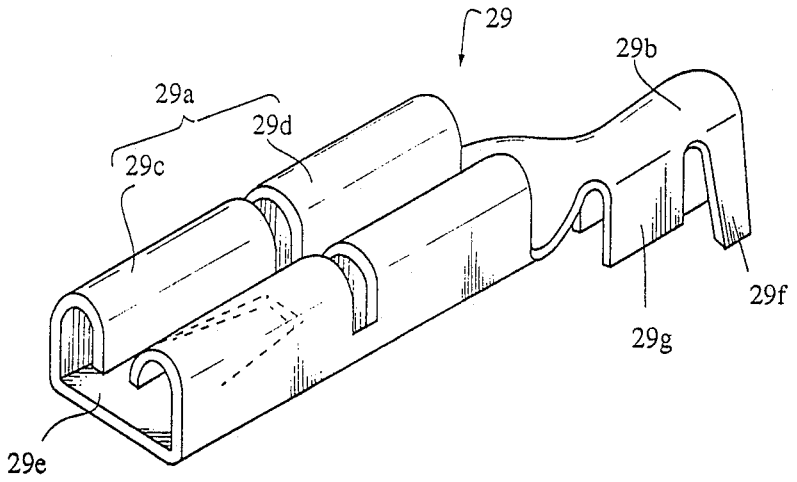
FIG. 4 is an enlarged perspective view of a female terminal of the embodiment.

The female terminal 29 accommodated in the male housing 24 has such a structure as shown in FIG. 4. Namely, the female terminal 29 comprises a tab receptacle section 29*a* and a wire connecting section 29*b* to which the wire 23 is connected.

The tab receptacle section 29*a* includes a first and a second tab receptacles 29*c* and 29*d* which are aligned toward the longitudinal direction thereof. Each of the tab receptacle portions 29*c* and 29*d* is formed by inwardly bending both sides of a base plate portion 29*e* of the terminal 29 so as to form a semi-circular shape, respectively.

The wire connecting section 29*b* comprises a pair of insulator holding parts 29*f* and a pair of wire holding parts 29*g*, which are provided so as to protruded from the back side of the terminal opposite to the side of the terminal on which the tab receptacles 29*c* and 29*d* are provided. The insulator holding parts 29*f* secures an insulator of the wire 23 by bending them so as to hold the insulator therewith, and the wire holding parts 29*g* secures a conductor of the wire 23 by bending them so as to hold the conductor therewith.

The terminals 29 are accommodated in the compartments 25 provided in the male housing 24 in such a manner that tab receptacle sections 29*a* of the terminals 29 accommodated in the upper and lower compartments 25 are opposite to each other through a partition formed between the compartments 25 of the upper and lower rows.

The female and male housings 22 and 24 are connected together by inserting the front portion 24*a* of the male housing 24 into the opening 22*b* of the female housing 22. Then, each of the tab portions 27*a* of the terminals 27 accommodated in the female housing 22 is fitted into the first tab receptacle of the terminal 29 accommodated in the male housing 24, thus attaining electrical connection between the male and female terminals 27 and 29 of the female and male housings 22 and 24.

Figure 5:
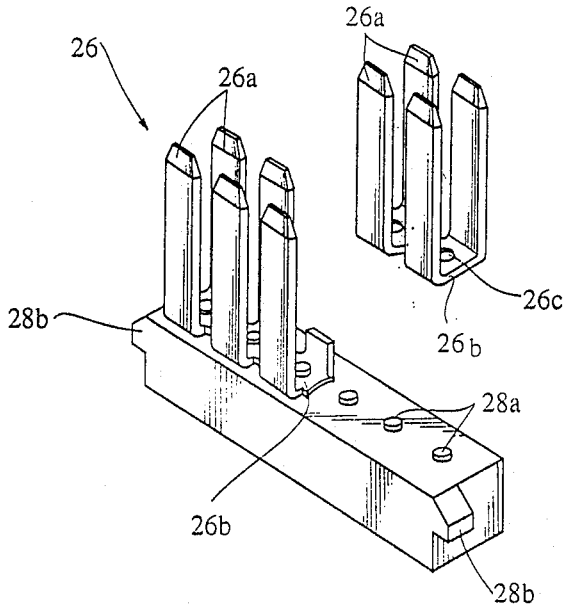
FIG. 5 is a perspective view of a joint terminal of the embodiment.

The joint terminal 26 includes at least one substantially U-shaped contact having two tab portions 26*a* and a base portion 26*b* formed between the tab portions 26*a*. A boss hole 26*c* is formed on the base portion 26*b* of the joint terminal 26 as shown in FIG. 5. The interval between the tab portions 26*a* of each contact is set so as to be substantially equal to the interval between the second tab receptacles 29 disposed in the face to face compartments 25 of the upper and lower rows.

The joint terminal 26 is mounted to an insulating holder 28 by fitting the boss hole 26*c* thereof to a boss 28*a* formed on the insulating holder 28. The insulating holder 28 has engagement protrusions 28*b* to be engaged with engagement portions 24*d* formed on rear portion 24*c* of the male housing 24.

As shown in FIG. 2, the insulating holder 28 having a plurality of U-shaped contacts is fitted to the male housing 24 from the rear portion thereof by inserting the tab portions 26*a* of the contacts of the joint terminal 26 into the compartments 25 of the housing 24. Then, the tab portions 26*a* of each contact of the joint terminal 26 are fitted to the second tab receptacles 29*d* which are accommodated in the compartments 25 of the upper and lower rows. Therefore, an electrical connection between terminals 29 in the upper and lower compartments 25 is achieved by the joint terminal 26. This arrangement is shown in FIG. 3.

In this case, if base portions 26*b* of the contacts of the joint terminal 26 are formed as a single part, it is possible to achieve electrical connection among the wires 1 and 3 connected with the male, female and joint terminals. Further, it is of course possible to increase or decrease the number of contacts of the joint terminal in accordance with the necessity of electrical connection between wires.

Figure 6:
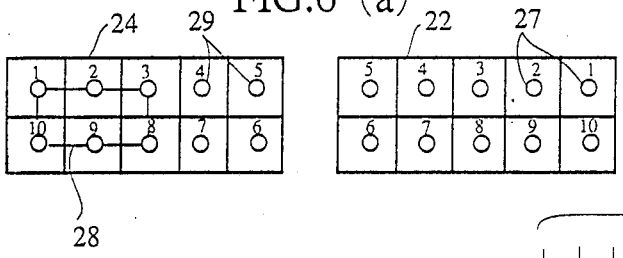
FIGS. 6 (*a*) and 6 (*b*) are explanatory drawings showing operation state of the embodiment.
Figure 6:
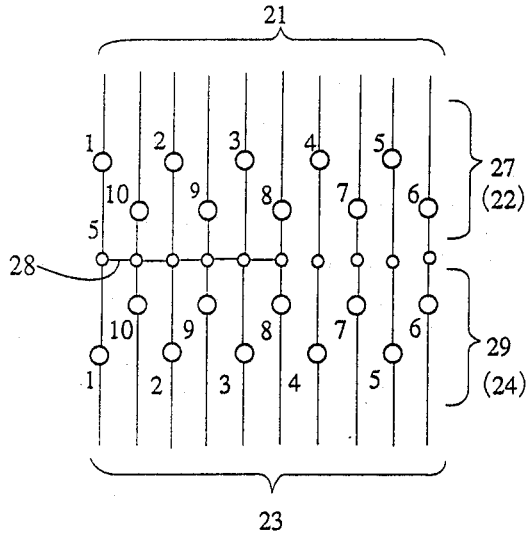
Figure 7:
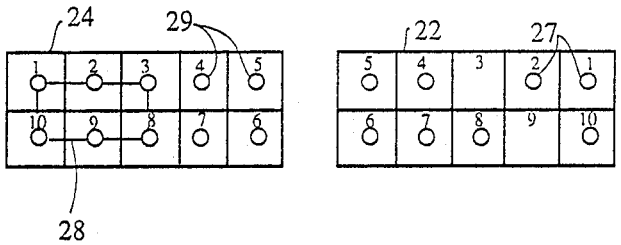
FIGS. 7 (*a*) and 7 (*b*) are explanatory drawings showing another operation state of the embodiment.
Figure 7:
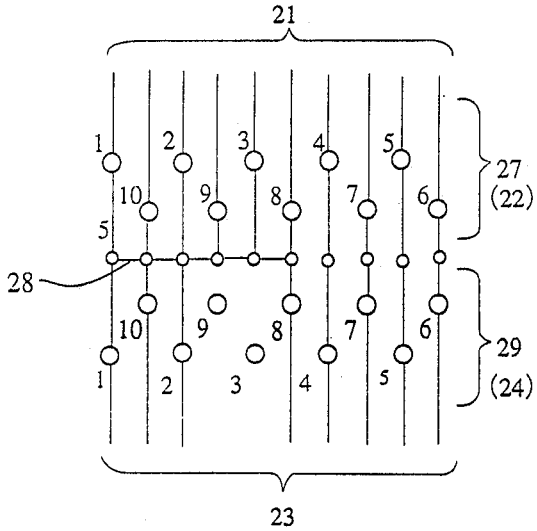

FIGS. 6(*a*) and 6(*b*) and FIGS. 7(*a*) and 7(*b*) show operation states of the connector of the embodiment. In this regard, please not that in the figures the numbers of 1 to 10 show male and female terminals accommodated in the female and male housings 22 and 24, respectively.

In the example shown in FIGS. 6(*a*) and 6(*b*), female terminals 29 indicated by the numerals 1, 2, 3, 8, 9 and 10 are connected to each other by the joint terminal 28 having three U-shaped contacts connected to each other. Further, as shown in FIG. 6(*b*), wires 23 connected to the female terminals 29 which are indicated by the numerals 1, 2, 3, 8, 9 and 10 are also electrically connected to wires 21 connected to the male terminals 27 indicated by the numerals 1, 2, 3, 8, 9 and 10. Therefore, electrical connection among the wires 21 and 23 are also achieved. The remaining wires 21 and 23 connected to the female and male terminals 27 and 29 indicated by the numeral 4, 5, 6 and 7, respectively, are simply connected to each other by the connections of the male and female terminals 27 and 29.

FIGS. 7(*a*) and 7(*b*) show another example, in which two male terminals corresponding to the female terminals 29 numbered with the numerals 3 and 9 are not provided in the female housing 22. Further, female terminals 29 numbered with the numerals 1, 2, 3, 8, 9 and 10 are connected to each other by the joint terminal 28 having three U-shaped contacts connected to each other. In this case, the male terminals 27 in the female housing 22 numbered with the numerals 1, 2, 8 and 10 are short-circuited to each other by the joint terminal 28. The remaining wires 21 and 23 connected to the female and male terminals 27 and 29 indicated by the numerals 4, 5, 6 and 7, respectively, are simply connected to each other by the connections of the male and female terminals 27 and 29.

As stated in the foregoings, by changing the arrangements of U-shaped contacts of the joint terminal or by changing the number of the male or female terminals 27 and 29, it is possible to easily obtain various type electrical connection states. Therefore, according to the electrical connector of the present invention, various electrical wiring can be made among the wires.

It is to be understood that even though the present invention has been described in its preferred embodiment, many modification and improvements may be made without departing from the scope of the invention as defined by the appended claims.

What is claimed is:

1. An electrical connector, comprising:

(a) a connector housing having a plurality of terminal compartments arranged in upper and lower rows each having the same number compartments;

(b) a plurality of terminals, each of the terminals being accommodated in each terminal compartment of the connector housing, wherein each of the terminals has both longitudinal ends and has an upper side and a lower side opposite to the upper side, which comprises:

(i) an electrical wire connecting section to which an electrical wire is connected, the electrical wire connecting section being formed at one end of the terminal on the upper side thereof; and (ii) a tab receptacle section provided at the other end of the electrical terminal on the lower side thereof, the tab receptacle section comprising a first tab receptacle to which a mating terminal in a mating connector housing is to be fitted and a second tab receptacle adjacent to the first tab receptacle, which are aligned toward the longitudinal direction of the terminal, wherein the terminals are accommodated in the terminal compartments in such a manner that the tab receptacle sections of the terminals in the upper and lower compartments are face to face through a partition between the upper and lower compartments; and (c) a joint terminal to be fitted to the second tab receptacle of selected terminals for achieving electrical connection between selected terminals, the joint terminal comprising at least two tab portions to be fitted to the second tab receptacle of the terminals, a base portion connected between the tab portions, and an insulating holder mounted on the base portion of the joint terminal, wherein the insulating holder of the joint terminal is placed between the electrical wire connecting sections of the terminals accommodated in the upper and lower rows of the terminal compartments when the joint terminal is properly fitted to the terminals in the connector housing.

2. The electrical connector as claimed in claim 1, wherein the connector housing is a male housing, the mating connector housing is a female housing, the terminal is a female terminal and the mating terminal is a male terminal.

3. The electrical connector as claimed in claim 2, wherein the male housing has a front portion to be fitted to the female housing and a rear portion, and the joint terminal is fitted to the second tab receptacles of the terminals from the rear portion of the male housing.

4. The electrical connector as claimed in claim 3, wherein the joint terminal comprises a substantially U-shaped contact having two tab portions and base portion.

5. The electrical connector as claimed in claim 4, wherein the joint terminal comprises more than two U-shaped contacts electrically connected to each other.

* * * * *